US006027225A

United States Patent [19]

Martin et al.

[11] Patent Number: 6,027,225

[45] Date of Patent: Feb. 22, 2000

[54] BATTERY POWERED LIGHT HAVING SOLAR AND INDUCTIVE CHARGING MEANS

[76] Inventors: William E. Martin; Robert Hallman, Sr., both of 260 S. Water St., Kittanning, Pa. 16201

[21] Appl. No.: 08/997,902

[22] Filed: Dec. 24, 1997

[51] Int. Cl.[7] ..... F21S 9/00

[52] U.S. Cl. ..... 362/183; 362/101; 136/291

[58] Field of Search ..... 362/183, 101; 136/244, 291; 320/108

[56] References Cited

U.S. PATENT DOCUMENTS

| | | | |
|---|---|---|---|
| 4,410,930 | 10/1983 | Yachabach | 362/145 |
| 5,003,441 | 3/1991 | Crowe et al. | 362/183 |
| 5,210,804 | 5/1993 | Schmid | 381/69.2 |
| 5,329,716 | 7/1994 | Fite | 362/183 X |
| 5,367,442 | 11/1994 | Frost et al. | 362/183 |
| 5,630,660 | 5/1997 | Chen | 362/183 |

*Primary Examiner*—Laura K. Tso

[57] ABSTRACT

A Battery Powered Light Having Solar and Inductive Charging Means for providing a rechargeable, water-proof light unit for use in fish ponds, swimming pools and the like. The light unit may additionally be hung to decoratively add to the surrounding ambiance. The device includes a rechargeable electrical power source disposed within a hollow, light transmissive housing having an open top portion, a cover releasably and sealably attachable to the open top portion, a light source disposed within the housing and operatively coupled to the rechargeable electrical power source, and a solar cell array disposed upon the cover and operatively coupled to the rechargeable electrical power source. A voltage divider circuit including a resistor and a cadmium sulfide cell disposed on the cover is operatively coupled to the light source to provide for selective energizing and de-energizing of the light source.

3 Claims, 2 Drawing Sheets

BATTERY POWERED LIGHT HAVING SOLAR AND INDUCTIVE CHARGING MEANS

BACKGROUND OF THE INVENTION

1. Field of the Invention

The present invention relates to solar powered lighting devices and more particularly pertains to a portable, water-proof light unit rechargeable by means of a solar cell array and having a light sensor to permit energization of the light only when the ambient light is sufficiently low. Alternatively the light unit is rechargeable by means of an air core transformer and rectifying means.

2. Description of the Prior Art

The use of solar powered lighting devices is known in the prior art. More specifically, solar powered lighting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art solar powered lighting devices include U.S. Pat. No. 4,823,241; U.S. Pat. No. 5,155,668; U.S. Pat. No. 5,211,470; U.S. Pat. No. 5,217,296; and U.S. Pat. No. 4,782,432.

While these devices fulfill their respective, particular objectives and requirements, the aforementioned patents do not disclose a new Battery Powered Light Having Solar and Inductive Charging Means. The inventive device includes a rechargeable electrical power source disposed within a hollow, light transmissive housing having an open top portion, a cover releasably and sealably attachable to the open top portion, a light source disposed within the housing and operatively coupled to the rechargeable electrical power source, and a solar cell array disposed upon the cover and operatively coupled to the rechargeable electrical power source. A circuit means responsive to ambient light for selectively energizing and de-energizing the light source is also disposed upon the cover.

In these respects, the Battery Powered Light Having Solar and Inductive Charging Means according to the present invention substantially departs from the conventional concepts and designs of the prior art, and in so doing provides an apparatus primarily developed for the purpose of providing a rechargeable, water-proof light unit for use in fish ponds, swimming pools and the like. Additionally the light unit may be hung to decoratively add to the surrounding ambiance.

SUMMARY OF THE INVENTION

In view of the foregoing disadvantages inherent in the known types of solar powered lighting devices now present in the prior art, the present invention provides a new Battery Powered Light Having Solar and Inductive Charging Means construction wherein the same can be utilized for providing a rechargeable, water-proof light unit for use in fish ponds, swimming pools and the like. Additionally the light unit may be hung to decoratively add to the surrounding ambiance.

The general purpose of the present invention, which will be described subsequently in greater detail, is to provide a new Battery Powered Light Having Solar and Inductive Charging Means apparatus and method which has many of the advantages of the solar powered lighting devices mentioned heretofore and many novel features that result in a new Battery Powered Light Having Solar and Inductive Charging Means which is not anticipated, rendered obvious, suggested, or even implied by any of the prior art solar powered lighting devices, either alone or in any combination thereof.

To attain this, the present invention generally comprises a rechargeable electrical power source disposed within a hollow, light transmissive housing having an open top portion, a cover releasably and sealably attachable to the open top portion, a light source disposed within the housing and operatively coupled to the rechargeable electrical power source, and a solar cell array disposed upon the cover and operatively coupled to the rechargeable electrical power source. A circuit means responsive to ambient light for selectively energizing and de-energizing the light source is also disposed upon the cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Battery Powered Light Having Solar and Inductive Charging Means apparatus and method which has many of the advantages of the solar powered lighting devices mentioned heretofore and many novel features that result in a new Battery Powered Light Having Solar and Inductive Charging Means which is not anticipated, rendered obvious, suggested, or even implied by any of the prior art solar powered lighting devices, either alone or in any combination thereof.

It is another object of the present invention to provide a new Battery Powered Light Having Solar and Inductive Charging Means which may be easily and efficiently manufactured and marketed.

It is a further object of the present invention to provide a new Battery Powered Light Having Solar and Inductive Charging Means which is of a durable and reliable construction.

An even further object of the present invention is to provide a new Battery Powered Light Having Solar and Inductive Charging Means which is susceptible of a low cost of manufacture with regard to both materials and labor, and which accordingly is then susceptible of low prices of sale to the consuming public, thereby making such Battery Powered Light Having Solar and Inductive Charging Means economically available to the buying public.

Still yet another object of the present invention is to provide a new Battery Powered Light Having Solar and Inductive Charging Means which provides in the apparatuses and methods of the prior art some of the advantages thereof, while simultaneously overcoming some of the disadvantages normally associated therewith.

Still another object of the present invention is to provide a new Battery Powered Light Having Solar and Inductive Charging Means for providing a rechargeable, water-proof light unit for use in fish ponds, swimming pools and the like. Additionally the light unit may be hung to decoratively add to the surrounding ambiance.

Yet another object of the present invention is to provide a new Battery Powered Light Having Solar and Inductive Charging Means which includes a rechargeable electrical power source disposed within a hollow, light transmissive housing having an open top portion, a cover releasably and sealably attachable to the open top portion, a light source disposed within the housing and operatively coupled to the rechargeable electrical power source, and a solar cell array disposed upon the cover and operatively coupled to the rechargeable electrical power source. A circuit means responsive to ambient light for selectively energizing and de-energizing the light source is also disposed upon the cover.

Still yet another object of the present invention is to provide a new Battery Powered Light Having Solar and Inductive Charging Means that includes a loop integrally formed on the housing for tethering the light unit to the bottom of the fish pond, swimming pool or the like.

Yet another object of the present invention is to provide a new Battery Powered Light Having Solar and Inductive Charging Means that is easily recharged.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
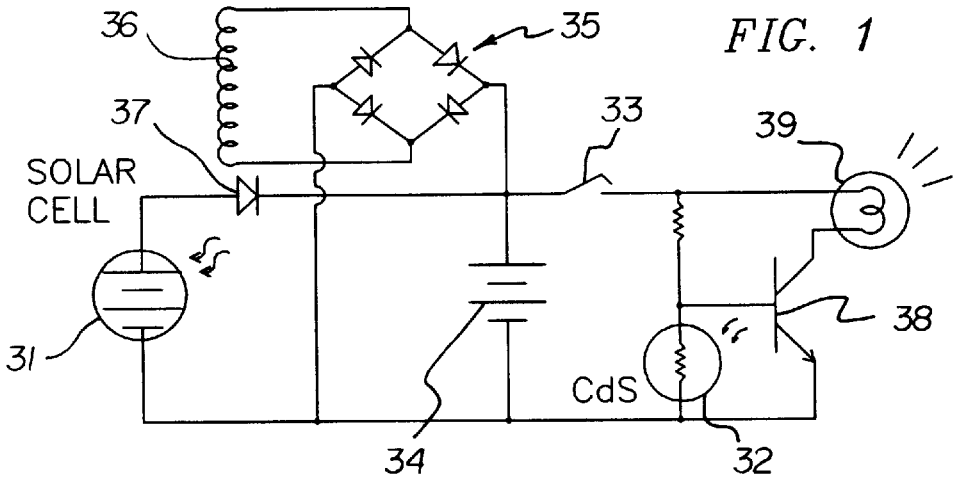
FIG. 1 is a schematic view of the circuitry disposed within the housing.

With reference now to the drawings, and in particular to FIGS. 1 through 5 thereof, a new Battery Powered Light Having Solar and Inductive Charging Means embodying the principles and concepts of the present invention and generally designated by the reference numeral 10 will be described.

More specifically, it will be noted that the Battery Powered Light Having Solar and Inductive Charging Means 10 comprises a light unit having a rechargeable electrical power source 34 disposed in a hollow, light transmissive housing 12 having an open top portion 17 and a cover 20 releasably and sealingly attachable to the open top portion 17. A light source 39 is disposed within the housing 12 and is operatively coupled to the rechargeable electrical power source 34. A solar cell array 31 is operatively coupled to the rechargeable electrical power source 34.

With reference to FIG. 1 a solar cell array 31 is shown operatively coupled to a rechargeable electrical power source 34 such as a NiCd battery or batteries through a diode 37, whose function is to prevent the discharge of the battery 34 through the solar cell array 31 when the solar cell array 31 is not receiving sunlight and charging the rechargeable batteries 34. A light source 39 is shown including an incandescent bulb which is coupled to the battery 34 through a push button toggle switch 33 which in the preferred embodiment is shielded from exposure to water and moisture by a rubber membrane.

A circuit means responsive to ambient light for selectively energizing and de-energizing the light source 39 is shown including a voltage divider formed by a resistor R and a cadmium sulfide cell 32. The resistance of the CdS cell 32 decreases in the presence of light. With increasing darkness, the resistance of the CdS cell 32 increases to the point at which the base-emitter junction of a transistor switch 38 is forward biased turning on the transistor 38 and energizing the light source 39.

Figure 5:
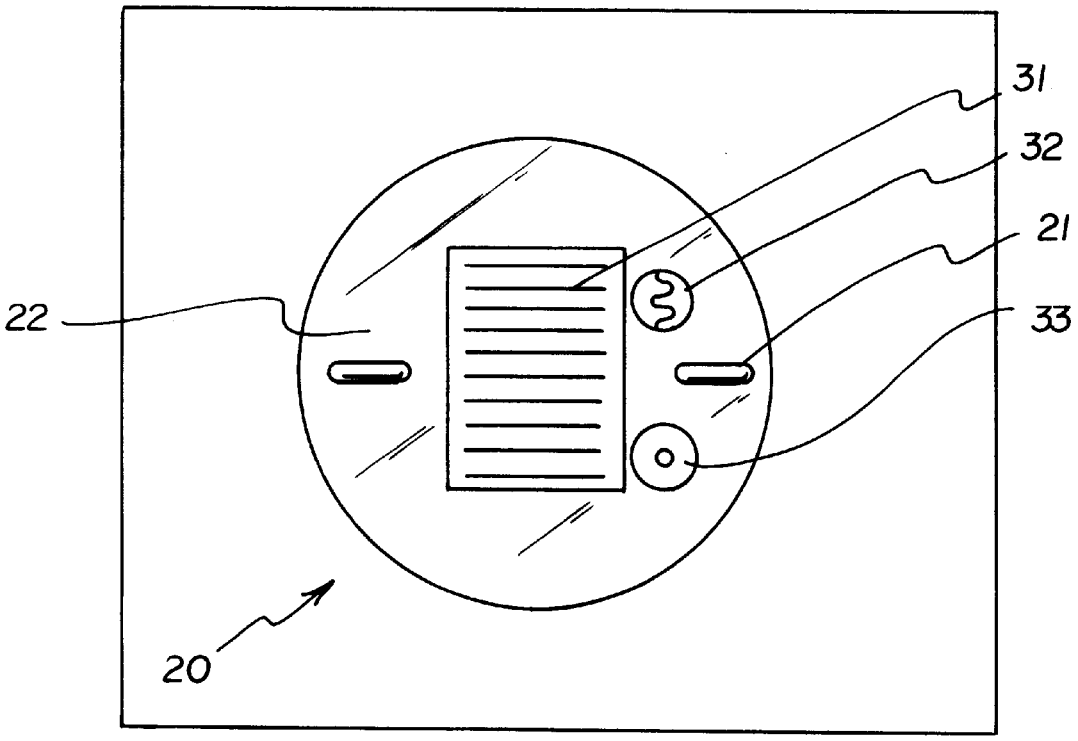
FIG. 5 is a plan view of the cover of the housing.

With reference to FIG. 5, the cover 20 is shown including a top surface 22. As shown, the solar cell array 31 and the CdS cell 32 are exposed to sunlight under normal operating conditions as will be described further hereinbelow. The push button toggle switch 33 is also shown disposed upon the cover top surface 22.

Figure 2:
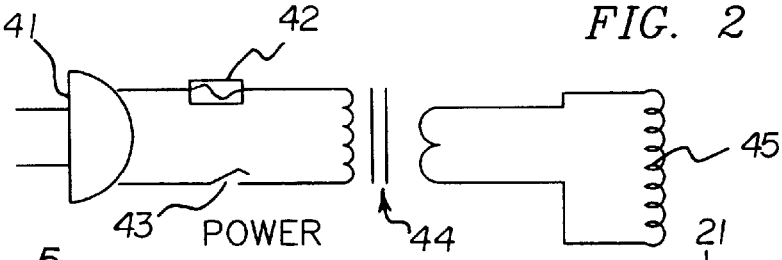
FIG. 2 is a schematic view of the circuitry disposed within the charging cradle of the present invention.

With reference to FIGS. 1 and 2, a means for inductively charging the rechargeable battery 34 is shown including a secondary coil 36 operatively coupled to the rechargeable battery 34 through a rectifier bridge 35. A primary coil 45 is shown operatively coupled to a step down transformer 44 which includes a plug 41. A fuse 42 is shown for protecting the step down transformer 44 and a power switch 43 is also shown. The step down transformer 44 preferably steps down the voltage from 110 VAC to 12 VAC. The secondary coil 36 and the rectifier bridge 35 are shown disposed within the housing 12 (FIG. 3) and the primary coil and transformer 44 are shown disposed in a charging cradle 50. Preferably the secondary coil 36 has approximately half the number of windings as the primary coil 45 to effectively charge the rechargeable battery 34. The housing 12 is preferably receivable within a charging cradle receiving portion 57 in such manner that the primary coil 45 and the secondary coil 36 are parallel for maximum flux linkage and forming an air core transformer (FIG. 4).

Figure 3:
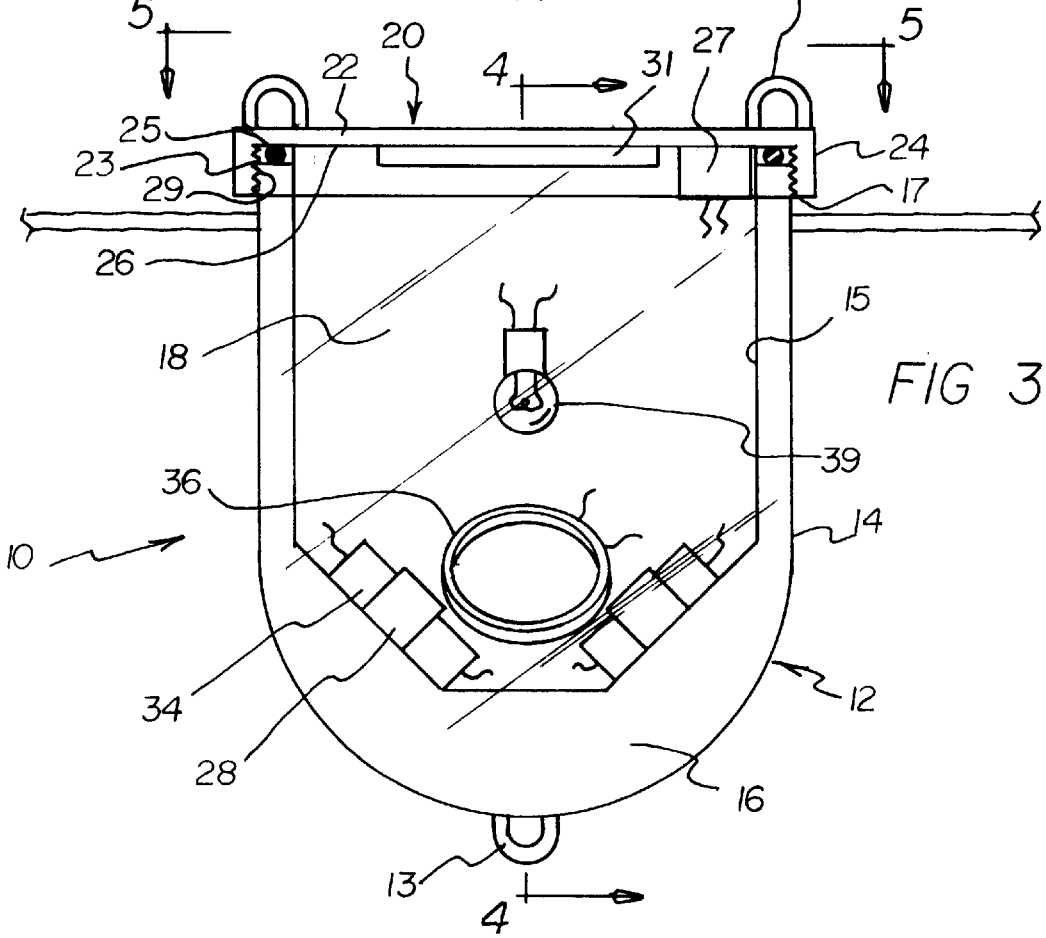
FIG. 3 is sectional view of the housing of the present invention.
Figure 4:
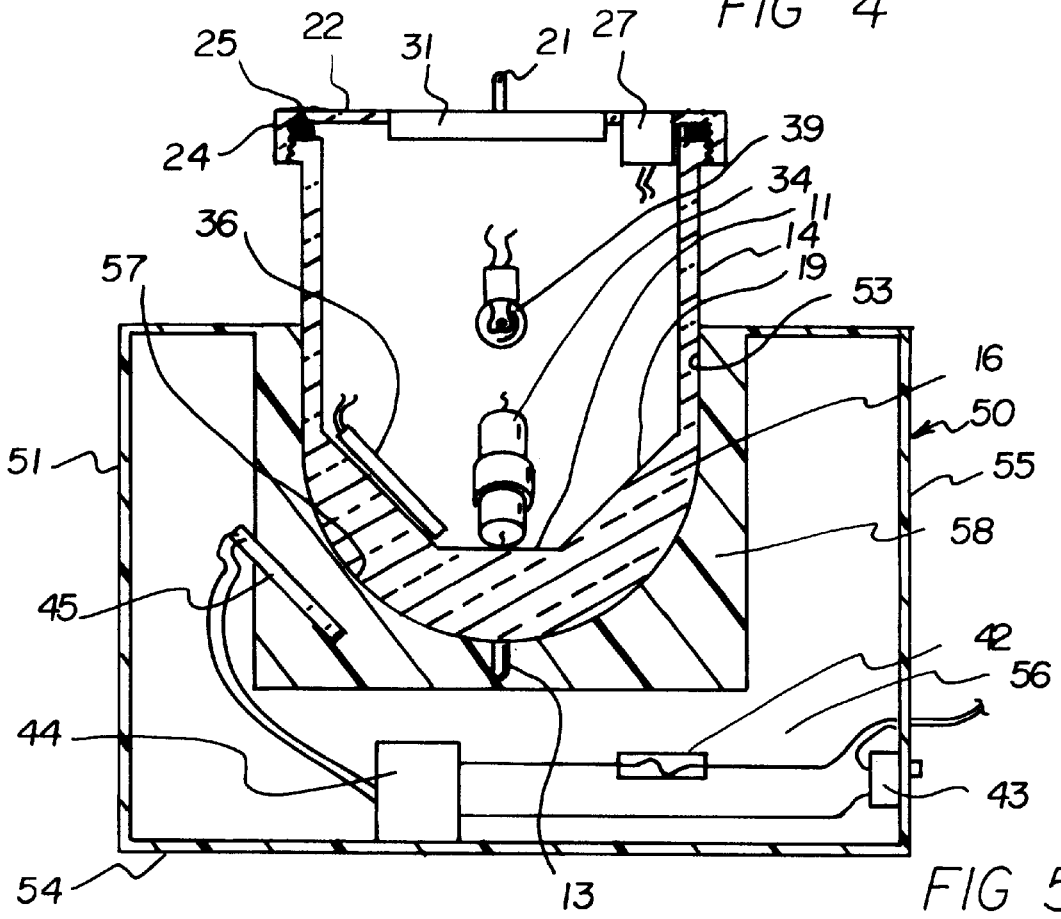
FIG. 4 is a cross sectional view taken along line 4—4 of FIG. 3.

With reference to FIGS. 3 and 4 there is shown the light unit including the cylindrical housing 12. The housing 12 includes an open top portion 17 and a convex bottom portion 16. A light source 39 is mounted within the housing 12 by conventional means. Shown integrally formed on the bottom portion outer surface 14 is a loop 13 designed for tethering the housing 12. The housing 12 is shown including a hollow interior 18 which is bounded by an inner surface 15 including a bottom surface 11 and an angled surface 19. Shown attached to the angled surface 19 by means of Velcro™ 28 are a pair of rechargeable batteries 34. The secondary coil 36 is also shown disposed on the angled surface 19 between the rechargeable batteries 34.

A waterproof seal is formed between the housing 12 and the cover 20 by means of an O-ring 25 shown received between a housing top perimeter portion 23 and a cover inside surface 26. The cover 20 includes a side portion 24 shown extending perpendicularly and includes a threaded inner surface 29 for threadingly engaging the open top portion 17.

With reference to FIGS. 3 and 5 a pair of opposed loops 21 are shown integrally formed on the cover top surface 22. In use the loops 21 can be utilized to hang the housing 12 with string or the like. A housing 27 is also shown disposed in the housing 12 for containing the CdS cell 32 and the switch 33.

With reference to FIG. 4 the charging cradle 50 is shown including a housing 51 having the concave charging cradle receiving portion 57 formed therein bounded by walls 53. A base section 54 is shown supporting the transformer 44. A hollow portion 56 is shown bounded by the base section 54, a side section 55 and a solid portion 58. Shown disposed in the solid section 58 is the primary coil 45.

In use, the light unit, which is preferably molded of a light-transmissive material, is placed in a fish pond, swimming pool or the like with the cover 20 facing up. The weight of the bottom portion 16 together with the weight of the rechargeable batteries 34 serve to keep the light unit in this orientation in which the solar cell array 31 and the CdS cell 32 are facing out from the water and toward the sun and operating to recharge the rechargeable batteries 34 and function as a light sensor respectively. If desired, a rope or the like can be used to tether the light unit to the bottom of the pond or pool by means of attachment to the loop 13.

In conditions where there is insufficient sunlight, the rechargeable batteries 34 can be recharged by placing the housing 12 in the charging cradle 50 with the loop 13 aligned in recess 59. In this manner the primary coil 45 is aligned parallel to the secondary coil 36 for maximum flux linkage.

The rechargeable batteries 34 and the light source 39 are easily replaced if desired by removing the cover 20 from the housing 12 and replacing them.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-contained solar powered light powered by a rechargeable electrical power source comprising:

a hollow, light transmissive housing having an open top portion, a cover releasably attachable to the open top portion, a bottom portion, the bottom portion having an inner surface, and wherein the rechargeable electrical power source is releasably attachable to the inner surface;

a light source disposed within the housing, the light source being operatively coupled to the rechargeable electrical power source;

a solar cell array operatively coupled to the rechargeable electrical power source, the solar cell array being disposed on the cover;

a circuit means responsive to ambient light for selectively energizing and de-energizing the light source, the circuit means responsive to ambient light for selectively energizing and de-energizing the light source being disposed on the cover, the circuit means responsive to ambient light for selectively energizing and de-energizing the light source further comprising a voltage divider comprising a resistor and a cadmium sulfide cell operatively coupled to a transistor switch, the transistor switch being operatively coupled to the light source; and wherein the rechargeable electrical power source is disposed within the housing.

2. The self-contained solar powered light of claim 1, wherein the housing is cylindrical and the bottom portion further comprises a convex portion.

3. The self-contained solar powered light of claim 2 further comprising a charging means for inductively charging the rechargeable electrical power source, the charging means comprising a secondary coil operatively coupled to the rechargeable electrical power source through a rectifier and a primary coil operatively coupled to a transformer, the secondary coil and rectifier being disposed within the housing and the primary coil and transformer being disposed within a charging cradle, the housing being receivable within a charging cradle receiving portion in such manner that the primary and secondary coils are alignable in parallel for maximum flux linkage.

* * * * *